US007252563B2

(12) United States Patent
Ju

(10) Patent No.: US 7,252,563 B2
(45) Date of Patent: Aug. 7, 2007

(54) ELECTRICITY CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/385,796

(22) Filed: Mar. 22, 2006

(65) Prior Publication Data

US 2006/0223344 A1 Oct. 5, 2006

(30) Foreign Application Priority Data

Mar. 29, 2005 (CN) ..... 2005 2 0056231

(51) Int. Cl.
*H01R 4/48* (2006.01)

(52) U.S. Cl. ..... 439/862; 439/66; 439/500

(58) Field of Classification Search ..... 439/66, 439/91, 500, 591, 862
See application file for complete search history.

(56) References Cited

U.S. PATENT DOCUMENTS

| | | | | |
|---|---|---|---|---|
| 4,927,369 | A * | 5/1990 | Grabbe et al. | 439/66 |
| 5,324,205 | A * | 6/1994 | Ahmad et al. | 439/66 |
| 6,315,576 | B1 * | 11/2001 | Neidich | 439/66 |
| 6,488,513 | B1 * | 12/2002 | Neidich et al. | 439/66 |
| 6,990,733 | B2 * | 1/2006 | Lopata et al. | 29/834 |
| 2005/0045363 | A1 * | 3/2005 | Ju | 174/94 R |

* cited by examiner

*Primary Examiner*—James R. Harvey
(74) *Attorney, Agent, or Firm*—Troxell Law Office, PLLC

(57) ABSTRACT

An electricity connector to connect two electronic devices abutted to each other includes an insulation body and multiple conductor terminals, and multiple channels disposed on the insulation body to accommodate the conductor terminals; each conductor terminal including an upper contacting portion, a lower contacting portion, and a retaining portion each on both sides to enable the conductor terminal maintaining better flexibility, warrant improved electricity connection between two abutted electronic devices, and allow easier assembly.

16 Claims, 4 Drawing Sheets

ELECTRICITY CONNECTOR

BACKGROUND OF THE INVENTION (a) Field of the Invention

The present invention is related to an electricity connector, and more particularly, to one connects to an LGA chip module of circuit board.

(b) Description of the Prior Art

An electricity connector is usually used to connect a LGA chip module to a circuit board. The electricity connector generally includes multiple terminals. U.S. Pat. No. 6,488,513 of the prior art teaches an electricity connector that relates to one having multiples terminals arranged in high density and both ends contacting by compression two electronic devices abutted to it. The prior art includes an insulation body and multiple terminals. Wherein, those terminals are approximately arranged in a C shape and each is comprised of an upper elastic arm, a lower elastic arm, and a main portion. Both of the upper and the lower elastic arms respectively extend from the upper and the lower ends of the main portion with the lower elastic arm approximately indicating a flat "—" shape having its terminal contacting by compression a metal pad provided on an electronic device (circuit board).

However, the prior art is found with the following flaws: terminals of the electricity connector being vulnerable to fatigue after long-term compression thus to affect the electricity connection between terminals and the abutted electronic device; and comparatively complicated assembly between the terminals and the insulation body of the electricity connector.

Therefore, a new design of the electricity connector is warranted to overcome those flaws found with the prior art.

SUMMARY OF THE INVENTION

The primary purpose of the present invention is to provide an electricity connector that warrants stable electricity connection between two abutted electronic devices and easy assembly.

To achieve the purpose, the present invention applied in electricity connection between two electronic devices includes an insulation body and multiple conductor terminals. The insulation body contains multiple channels to receive corresponding conductor terminals. Each conductor terminal includes an upper contacting portion, a lower contacting portion, and two retaining portions respectively disposed on both sides to respectively compromise the insulation body elastically.

When compared to the prior art, each conductor terminal and the insulation is mated in the fashion of an indention and a protrusion in the present invention thus to maintain better elasticity, warrant better electricity connection with the abutted electronic device, and allow easier assembly.

DETAILED DESCRIPTION ON OF THE PREFERRED EMBODIMENTS

Figure 1:
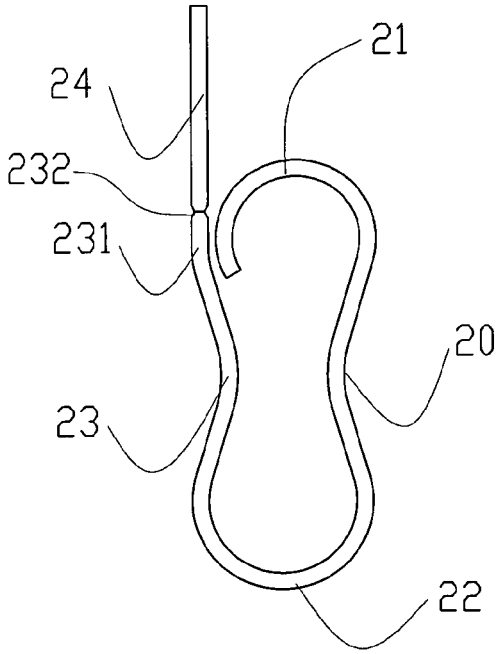
FIG. 1 is a schematic view showing that a conductor terminal of an electricity connector of the present invention is connected to a material band.

Referring to FIGS. 1~4, an electricity connector 1 comprised of an insulation body 1 and multiple conductor terminals 2 of the present invention connects an LGA chip module 3 to a circuit board 4. A first conductor pad 30 and a second conductor pad 40 are respectively provided to the chip module 3 and the circuit board 4.

The insulation body 1 is disposed with multiple channels 10 to accommodate a corresponding conductor terminal 2. One or a plurality of protruding portion 11 is provided in and rising toward the channel 10.

Figure 2:
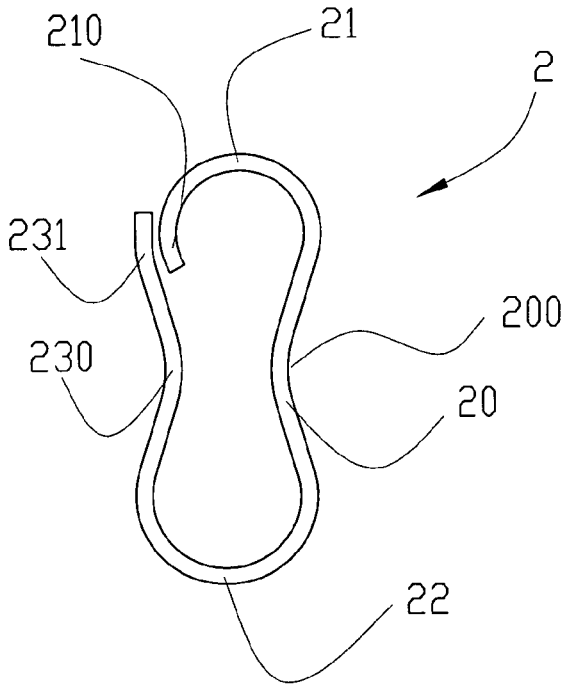
FIG. 2 is a schematic view of a conductor terminal of the electricity connector of the present invention.
Figure 3:
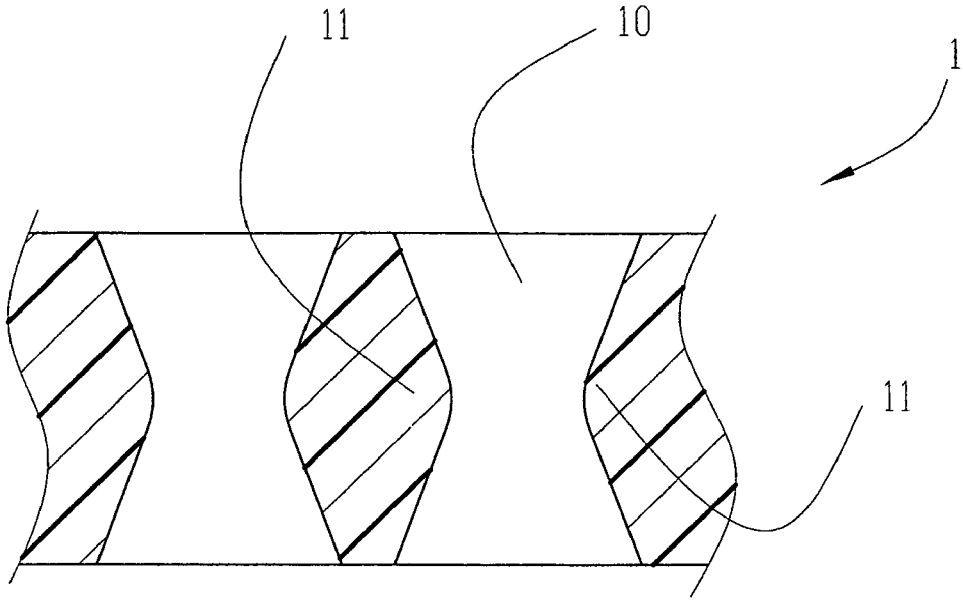
FIG. 3 is a sectional view of an insulation body of the electricity connector of the present invention.

The conductor terminal 2 is made of an integral sheet metal material curved in the form as illustrated in FIG. 2. The conductor 2 to be inserted into the channel 10 provides better elasticity either in horizontal or vertical direction and includes an upper contacting portion 21, a lower contacting portion 22, a first retainer 20 located at where between and connecting both of the upper and the lower contacting portions 21, 22, and a second retainer 23 extending upward from the terminal of the lower contacting portion 22. A terminal 231 of the second retainer 23 is provided with a connecting portion 232 to connect a conductor terminal material band 24. Each of both retainers is disposed with an indention 200, 230 to mate the protruding protrusion 11 of the insulation body thus to secure the conductor terminal 2 in the insulation body 1. Each of the upper and the lower contacting portions indicates an arc.

A first terminal 210 extends downward from the terminal of the upper contacting portion 21. When the upper contacting portion 21 is compressed, the first terminal 210 moves downward for a certain distance to contact the terminal 231 of the second retainer 23. Whereas the conductor terminal 2 allows larger space at its mid section and better elasticity to make it easier to be adapted to the insulation body 1.

Figure 4:
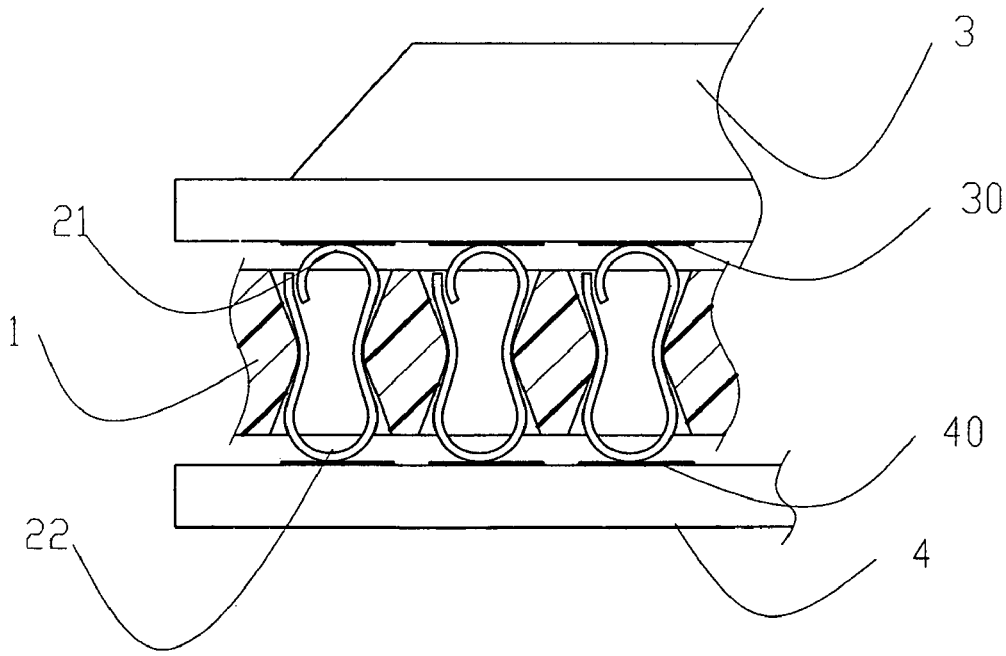
FIG. 4 is a schematic view showing the electricity connector of the present invention connects a chip module and a circuit board.
Figure 5:
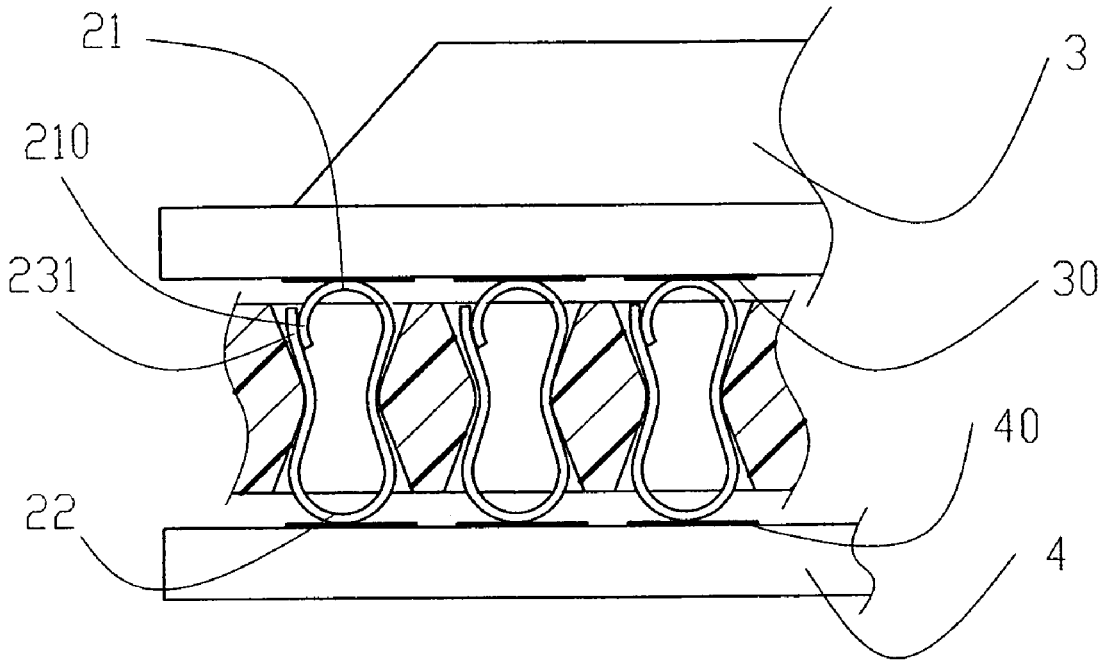
FIG. 5 is a schematic view showing that the electricity connector, the chip module, and the circuit board from FIG. 4 contact one another by compression.

When applied in connecting the LGA chip module 3 and the circuit board 4 as illustrated in FIGS. 4 and 5, both of the upper contacting portion 21 and the lower contacting portion 22 of the conductor terminal 2 respectively contact the first conductor pad 30 of the chip module 3 and the second conductor pad 40 of the circuit board 4 by compression, thus to realize the electricity connection between the chip module 3 and the circuit board 4 (also achieving the same purpose of connecting to the circuit board 4 by soldering). When a force applied to the chip module 3 to press it, the upper contacting portion 21 of the conductor terminal 2 moves downward to drive its first terminal 210 also to move downward, thus to allow the first terminal 210 contact the terminal 231 of the second retainer 23 for creating two conduction paths to reduce the resistance during the conduction of the current.

Figure 6:
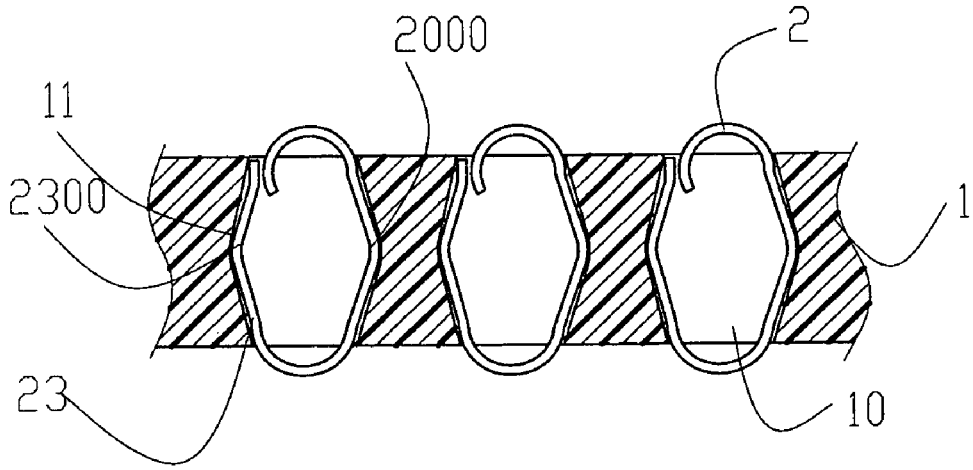
FIG. 6 is a schematic view showing a second preferred embodiment of the present invention.

Now referring to FIG. 6, two outwardly protruding portions 2000, 2300 are respectively provided to the retainers

20, 23; and corresponding indentions 11 are disposed in each channel 10 of the insulation body 1 to achieve the same results as that of the second preferred embodiment described above.

Figure 7:
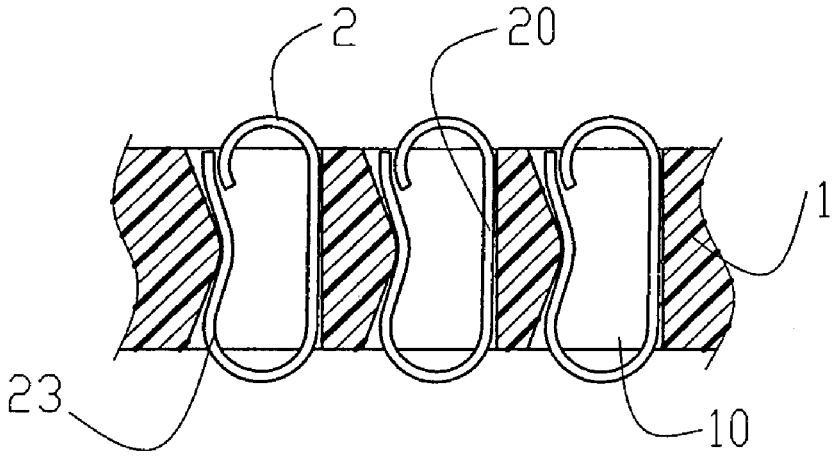
FIG. 7 is a schematic view showing a third preferred embodiment of the present invention.

As illustrated in FIG. 7, a third preferred embodiment differs from the first preferred embodiment in that one side of the first retainer 20 in the third preferred embodiment substantially indicate upright while only the second retainer 23 indicates an indenting portion to mate the protruding portion in the channel 10 of the insulation body 1.

Figure 8:
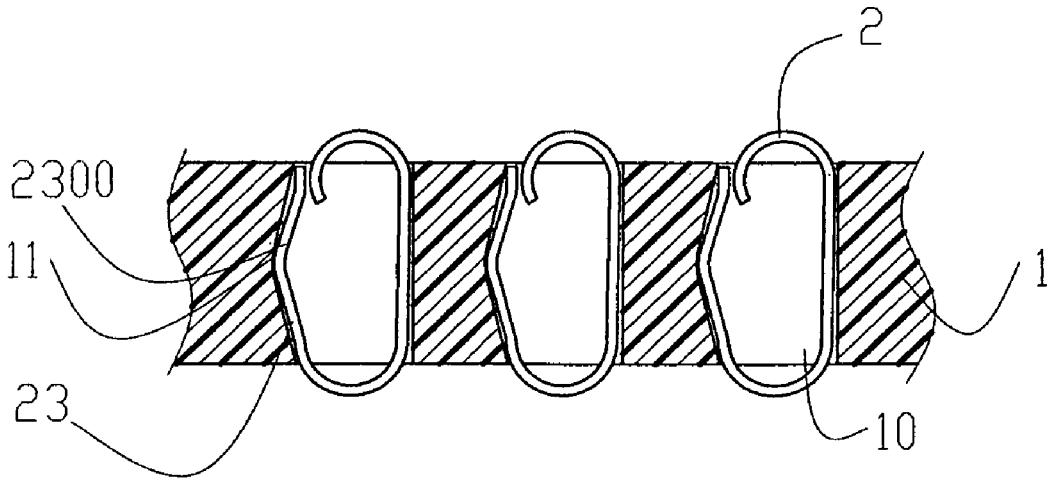
FIG. 8 is a schematic view showing a fourth preferred embodiment of the present invention.

A fourth preferred embodiment of the present invention as illustrated in FIG. 8 differs from the third preferred embodiment in that the outwardly protruding portion 2300 is disposed to the second retainer 23; and an indenting portion 11 is relatively provided in the channel 10 of the insulation body 1 to mate the protruding portion 2300 of the conductor terminal 2 to achieve the same results.

The electricity connector may be also used to connect two circuit boards in parallel to each other to realize similar results to that of the preferred embodiments of the present invention describe above.

What is claimed is:

1. An electricity connector applied in electricity connection between two abutted electronic devices includes an insulation body and multiple conductor terminals; multiple channels being disposed on the insulation body; each conductor terminal being accommodated in its corresponding channel of the insulation body; each conductor terminal includes an upper contacting portion, a lower contacting portion, and two retaining portions respectively provided on both sides of the conductor terminal; and both retaining portions being configured to be flexibly compressed to against the corresponding channel of the insulation body, wherein the retaining portion includes a first retainer disposed between two contacting portions, and a second retainer extending upward from the terminal of the lower contacting portion, wherein a first terminal extends downward from the upper contacting portion to extend past the terminal of the second retainer, and the first terminal when compressed moves downward to contact the terminal of the second retainer.

2. The electricity connector of claim 1, wherein the retaining portion and the accommodation channel are abutted to each other on both sides of the accommodation channel.

3. The electricity connector of claim 1, wherein both retainers are each disposed with an outwardly protruding portion in relation to the retainer; and a corresponding indenting portion is disposed on the channel of the insulation body to mate the protruding portion.

4. The electricity connector of claim 1, wherein both retainers are each disposed with an indenting portion in relation to each retainer; and a corresponding protruding portion is disposed on the channel of the insulation body to mate the indenting portion.

5. The electricity connector of claim 1, wherein one or both retainer is disposed with an outwardly protruding portion in relation to the retainer; and a corresponding indenting portion is disposed on the channel of the insulation body to mate the protruding portion.

6. The electricity connector of claim 1, wherein one or both retainer is disposed with an indenting portion in relation to the retainer, and a corresponding protruding portion is disposed on the channel of the insulation body to mate the indenting portion.

7. The electricity connector of claim 1, wherein the terminal of the second retainer is provided with a connecting portion to contact the material band of conductor terminal.

8. The electricity connector of claim 1, wherein both of the upper and the lower contacting portions contact LGA chip module or the circuit board by compression.

9. The electricity connector of claim 2, wherein both of the upper and the lower contacting portions contact LGA chip module or the circuit board by compression.

10. The electricity connector of claim 1, wherein both of the upper and the lower contacting portions contact LGA chip module or the circuit board by compression.

11. The electricity connector of claim 3, wherein both of the upper and the lower contacting portions contact LGA chip module or the circuit board by compression.

12. The electricity connector of claim 4, wherein both of the upper and the lower contacting portions contact LGA chip module or the circuit board by compression.

13. The electricity connector of claim 5, wherein both of the upper and the lower contacting portions contact LGA chip module or the circuit board by compression.

14. The electricity connector of claim 6, wherein both of the upper and the lower contacting portions contact LGA chip module or the circuit board by compression.

15. The electricity connector of claim 1, wherein both of the upper and the lower contacting portions contact LGA chip module or the circuit board by compression.

16. The electricity connector of claim 8, wherein both of the upper and the lower contacting portions contact LGA chip module or the circuit board by compression.

* * * * *